US010668747B2

(12) United States Patent
Lela

(10) Patent No.: US 10,668,747 B2
(45) Date of Patent: Jun. 2, 2020

(54) PRINTING SUCTION SYSTEM, PRINTING DEVICE HAVING A PRINTING SUCTION SYSTEM, AND PRINTING SUCTION METHOD

(71) Applicant: Océ Holding B.V., Venlo (NL)

(72) Inventor: Admir Lela, Haar (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/191,870

(22) Filed: Nov. 15, 2018

(65) Prior Publication Data

US 2019/0143720 A1 May 16, 2019

(30) Foreign Application Priority Data

Nov. 16, 2017 (DE) ..... 10 2017 126 985

(51) Int. Cl.
*B41J 11/00* (2006.01)
*B41J 15/04* (2006.01)

(52) U.S. Cl.
CPC ..... *B41J 11/0085* (2013.01); *B41J 11/0005* (2013.01); *B41J 15/04* (2013.01)

(58) Field of Classification Search
CPC .... B41J 11/0005; B41J 11/0085; B41G 15/04
USPC ..... 347/104
See application file for complete search history.

(56) References Cited

U.S. PATENT DOCUMENTS

2002/0109768 A1* 8/2002 Greive ..... B41J 11/0085 347/104
2005/0005800 A1* 1/2005 Stoot ..... B41J 11/0085 101/483
2006/0221166 A1* 10/2006 Inoue ..... B41J 11/0015 347/104
2008/0122890 A1 5/2008 Yorimoto
2009/0085947 A1 4/2009 Kado et al.
2010/0171782 A1 7/2010 Kado et al.
2013/0293605 A1 11/2013 Bar-Tal et al.
2014/0354716 A1 12/2014 Saito et al.
2015/0060512 A1* 3/2015 Kasiske, Jr. ..... B65H 23/24 226/95
2017/0210581 A1* 7/2017 Van Acquoij ..... B41J 13/0018

FOREIGN PATENT DOCUMENTS

DE 2721003 A1 11/1977
GB 1584211 A 2/1981

OTHER PUBLICATIONS

German Search Report—Application No. 10 2017 126 985.1, dated Apr. 13, 2018.

* cited by examiner

*Primary Examiner* — Huan H Tran
*Assistant Examiner* — Alexander D Shenderov
(74) *Attorney, Agent, or Firm* — Schiff Hardin LLP

(57) ABSTRACT

A printing suction system for a printer can include at least one print bar with at least one print head, and at least one suction device arranged in proximity to an underside of the print bar thereby forming a gap through which a recording medium that can be printed to by the print bar can be directed. The suction device can extend along at least a portion (or the entire) width of the print bar. The section device can generate a suction pressure based on a suction pressure profile to suction and smooth the recording medium.

19 Claims, 3 Drawing Sheets

PRINTING SUCTION SYSTEM, PRINTING DEVICE HAVING A PRINTING SUCTION SYSTEM, AND PRINTING SUCTION METHOD

CROSS REFERENCE TO RELATED APPLICATIONS

This patent application claims priority to German Patent Application No. 102017126985.1, filed Nov. 16, 2017, which is incorporated herein by reference in its entirety.

BACKGROUND

A printing suction system for a printer, in particular an ink printing apparatus, and a printer having at least one printing suction system, as well as a method for smoothing a recording medium by means of the printing device.

A web feed device for use in a printer is known from DE 27 21 003 A1. The web feed device is characterized by a belt drive device that imparts a transport force on a continuous paper web. The web feed device additionally has: a loading device arranged before or upstream of the drive device, as viewed in the web feed direction, which loading device may apply a tension to the web; as well as a deviation detector device.

Given this known web feed device, the loading device is arranged between a transfer device and a heated roller fixing device which transfers the developed image onto an image receiving material such as paper or other recording medium. The heated roller fixing device subsequently fuses the toner image onto the paper and fixes it. The web feed device thereby has the disadvantage that a formation of folds in the region of the transfer device may lead to disturbances in the print image.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
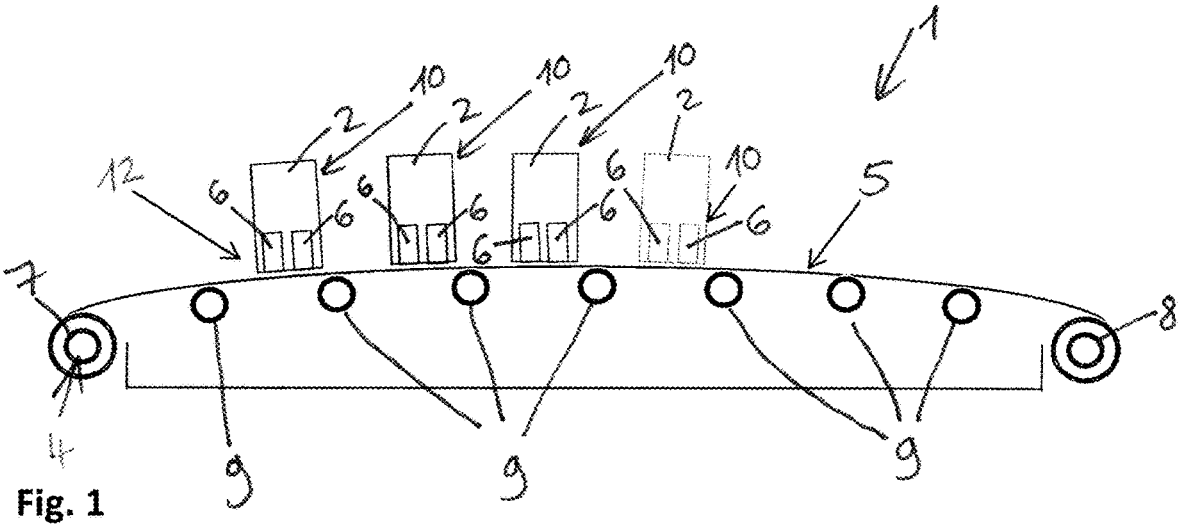
Figure 2:
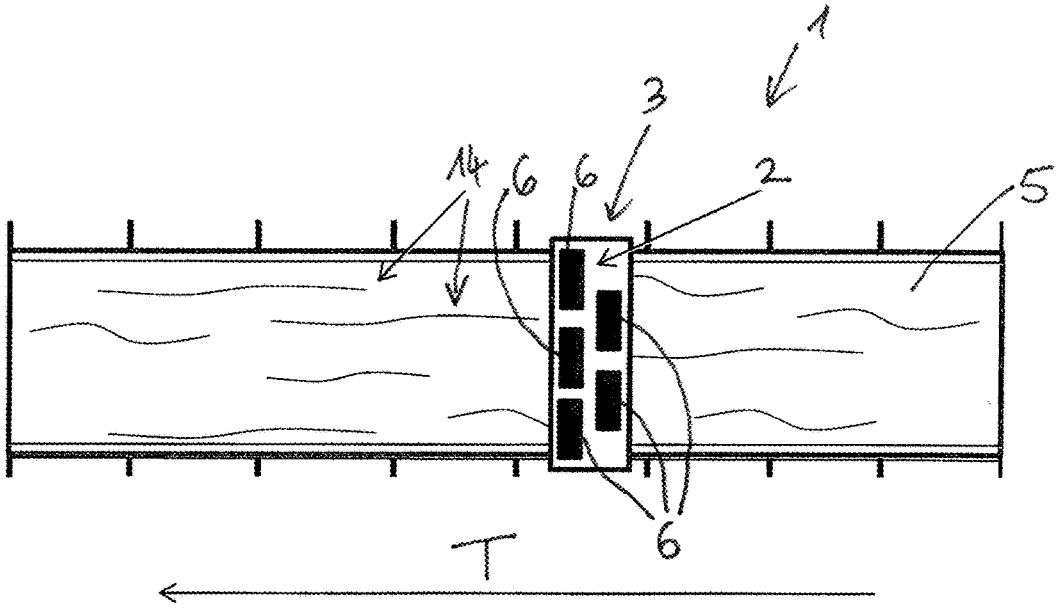
Figure 3:
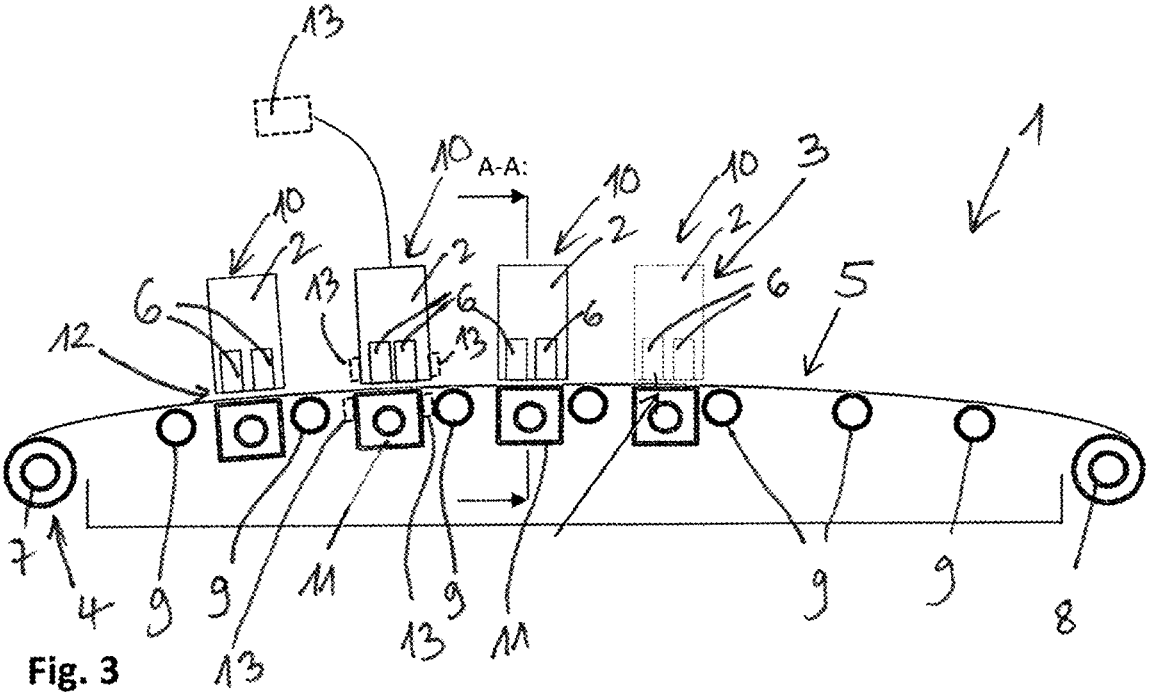
Figure 4:
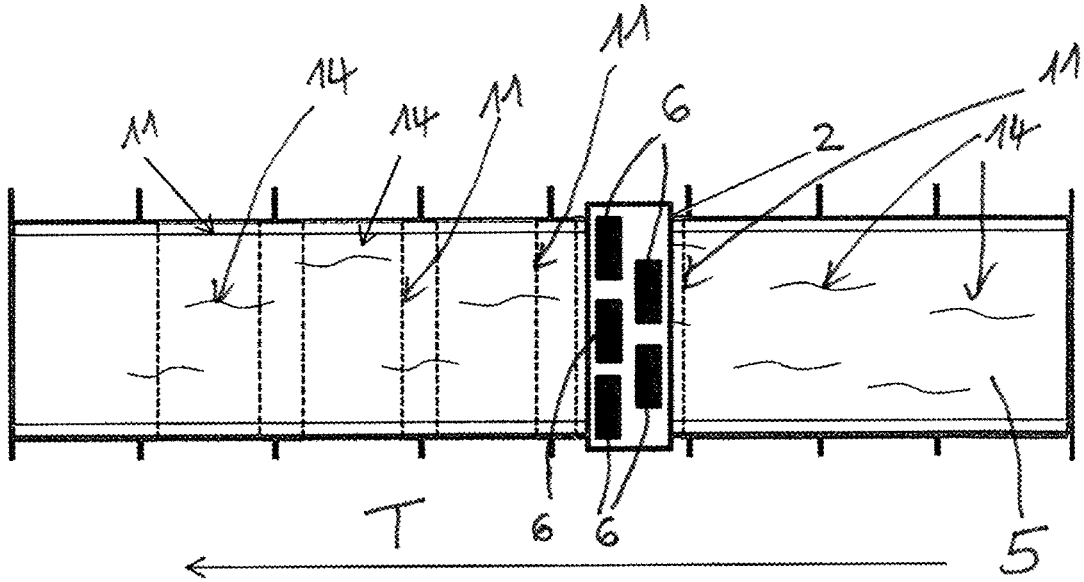
Figure 5:
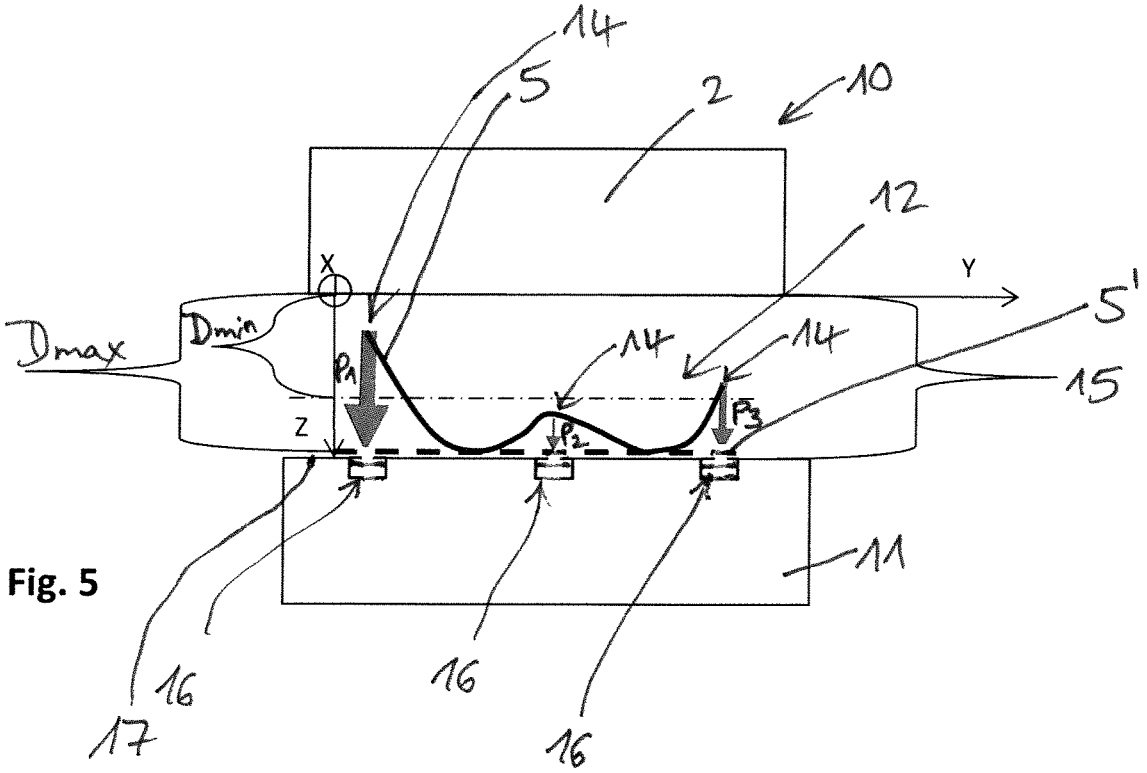

FIG. 1 a side view of a printer without a suction bar element;

FIG. 2 a plan view of a detail of the printer according to FIG. 1;

FIG. 3 a side view of a printer according to an exemplary embodiment of the present disclosure;

FIG. 4 a plan view of a detail of the printer according to an exemplary embodiment of the present disclosure as shown in FIG. 3; and FIG. 5 a cross-sectional view along A-A through a printing suction system, according to an exemplary embodiment, of the printer shown in FIG. 3.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to provide a printing suction system for a printer which provides a smoothing of a recording medium in the printing gap.

In an exemplary embodiment, a printing suction system for a printer, in particular an ink printing apparatus, includes at least one print bar having at least one print head; and at least one suction device which is arranged in proximity to the underside of the print bar, and with this forms a gap through which is directed a recording medium that can be printed to by the print bar, wherein the suction device extends along the width of the print bar and is configured to generate a suction pressure according to a suction pressure profile along the width of the print bar for suction and smoothing of the recording medium.

In one or more exemplary embodiments described herein, the expression "in proximity to" is to be understood as follows: The suction device may be arranged precisely opposite the underside of the print bar. The suction device may, however, be displaced somewhat from this opposite position, along the transport direction of the recording medium, so that the recording medium is first directed past the suction device and subsequently is directed past the corresponding print bar. In both instances, the recording medium travels between the print bars and the suction devices.

The printing suction system has the advantage that an undulation of the recording medium which occurs before or in the printing gap may be smoothed by the suction device, and therefore an unwanted contact between the print bar and the recording medium may be counteracted.

In an exemplary embodiment, a printer having at least one such printing suction system.

In an exemplary embodiment, a method for smoothing a printable recording medium in a printer includes: providing at least one printing suction system having a print bar and a suction device, directing the recording medium through the gap formed between the print bar and the suction disturbance device, and suctioning the recording medium via the suction device such that an undulation of the recording medium can be smoothed.

Embodiments of the present disclosure combine a suction device with the print bar. The suction device can provide a defined suction profile along the width of the print bar, in order to suction a recording medium directed through between the print bar and the suction device such that an undulation of the recording medium can be smoothed, and an unwanted contact between the print bar and the recording medium due to the undulation may be prevented.

In an exemplary embodiment of the disclosure, the suction pressure profile of the suction device has a continuous, constant suction pressure along the width of the print bar, or the suction pressure of the suction profile varies over the width of the print bar. A suction pressure level of the suction device that varies over the width of the print bar has the advantage that this may be specifically adapted depending on function and intended use.

In an exemplary embodiment of the disclosure, the curve of the suction pressure level of the suction pressure profile is adjusted along the width of the print bar, depending on the respective undulation of the recording medium. For example, the suction pressure level may be provided depending on the degree and/or the position of the undulation along the width of the print bar. For example, in this way the suction pressure may accordingly be provided to be higher in a region with a large ripple and be provided to be accordingly smaller in a region with a smaller ripple. A respective undulation of a recording medium may thus be rendered with further precision.

According to an exemplary embodiment of the disclosure, the printing suction system has at least one fold formation determination device (e.g. fold formation determiner), and/or is coupled with at least external fold formation determination device, to determine the undulation of the respective recording medium to be directed through the gap of the printing suction system, and to determine a suction pressure profile for smoothing of this undulation. Such a fold formation determination device has the advantage that a possibly present undulation of the recording medium is determined depending on the respective recording medium, and this information is used. The precision of the smoothing of the recording medium may thereby be increased. Furthermore, such information may be used by one or more external fold formation determination devices, such as ambient moisture sensors, ambient temperature sensors, ambient pressure sensors, or the like.

In an exemplary embodiment of the disclosure, the at least one fold formation determination device is configured to directly and/or indirectly detect at least one undulation of the recording medium to determine fold formation information. Instead of determining the undulation via measurement of the surface profile of the recording medium, for example, a moisture of the recording medium or a moisture distribution of the recording medium along the width of the print bar may be detected, and from this, an undulation of the recording medium may be concluded.

In an exemplary embodiment according to the disclosure, the at least one fold formation determination device is configured to retrieve, from a memory device, at least one item of fold formation information that is stored in advance for the recording medium, based on which the undulation of the recording medium can be determined directly or indirectly. For example, an undulation of the recording medium may be predicted using a print image to be produced on the recording medium, which the print image is stored in the memory device. For example, an ink quantity distribution may be determined based on the print image and may be used to predict an undulation that is hereby caused and to determine a suitable suction pressure profile, and said suction pressure profile is to be applied onto the recording medium upon passing through the printing gap of the printing suction system.

According to an embodiment, the fold formation information is, for example, the degree of moisture of the recording medium, the degree of ambient humidity, the ambient pressure, the density of the recording medium, the thickness of the recording medium, the width of the recording medium, the ambient temperature, a material fraction of the recording medium, a height deviation from an ideal line of the recording medium, a print image to be applied onto the recording medium, or a printing ink distribution on the recording medium. However, the disclosure is not limited to these examples of a fold formation information.

In an exemplary embodiment according to the disclosure, at least one fold formation determination device is configured to measure a surface contour of the recording medium, in particular by means of infrared, ultrasound, or laser. However, the disclosure is not limited to the cited examples for measurement of the surface contour.

In an exemplary embodiment of the disclosure, the suction pressure profile is calculated based on the established undulation of the recording medium, or is stored so that it can be retrieved from a memory device. For example, characteristic curves for suction profiles may be stored in advance in a memory device and subsequently be retrieved, and a suction pressure profile may possibly be interpolated therefrom.

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

Initially shown in FIGS. 1 and 2 is an example of a printer 1 whose print bars 2 have no additional suction device. Exemplary embodiments of a printer is subsequently described with reference to FIGS. 3-5. In an exemplary embodiment, the printer shown in FIGS. 3-5 has essentially the same design as the printer 1 according to FIGS. 1 and 2, and discussion of the printer with respect to FIGS. 3-5 has been limited for brevity. However, in an exemplary embodiment, the printer in FIG. 305 differs from the printer 1 according to FIGS. 1 and 2 in that the print bars respectively have an additional suction device to provide a printing suction arrangement made up of printing suction systems.

A side view of the printer 1 whose print bars 2 have no additional suction device is shown in FIG. 1. FIG. 2 additionally depicts a plan view of a detail of the printer 1 according to FIG. 1. The depictions in FIGS. 1 and 2 are hereby purely schematic and simplified for the ease of discussion.

As is depicted in FIGS. 1 and 2, the printer 1 has a print group 3 and a transport device 4 for a recording medium 5 that is to be printed to. In the shown example, the print group 4 has four print bars 2, wherein of these only one print bar 2 is shown in the detail in FIG. 2.

The different print bars 2 are thereby used for printing with inks of different color, for example.

For printing to the recording medium 5, the respective print bar 2 has one or, as is shown in FIGS. 1 and 2, more print heads 6. In the example in FIGS. 1 and 2, a recording medium 5 in the form of a web, for example a paper roll, is used as a recording medium 5. Such a recording medium 5 in the form of a web is typically taken off a roll 8, in particular a take-off, and then supplied to the print group 3 of the printer 1. A print image is applied onto the recording medium 5 by the print group 3. The recording medium 5 that is printed to may subsequently be taken up—for example after a drying and fixing of the print image—on an additional roll 7, in particular the take-up, or may be separated into sheets or pages, for example. However, the disclosure is not limited to this specific embodiment of printers 1 having take-up and take-off and to recording media in the form of webs.

To transport the recording medium 5 along the print group 3, a transport device 4 is provided which, for example, has multiple transport rollers 9, for example roll saddle rollers, as is indicated in FIGS. 1 and 2. The transport direction T of the recording medium 5 is indicated with an arrow in FIGS. 1 and 2.

Fold formation may occur in the recording medium 5 while the recording medium 5 is transported along the print group 3, for example if the recording medium 5 experiences tensile forces of unequal magnitude in the transport direction due to the transport rollers 9.

Such a fold formation in the recording medium 5 may lead to an unwanted contact between the recording medium 5 and a respective print head 6 of the print bar 2. Such a contacting of the recording medium 5 with the print head 6 may thereby result in damage to the print head 6, and cause a print image disturbance with permanent and variable nozzle failures. Furthermore, in such an instance it is necessary to exchange the print head 6 in order to reestablish a suitable print quality.

In particular, the folding or undulation 14 that arises in the fold formation may contact the nozzle plate of the print head 6, for example if the fold or ripple is created precisely at the moment below the nozzle plate of the print head 6 and contacts said nozzle plate. A Teflon layer, for example provided on the nozzle plate, may thereby be damaged. In this instance, exchanging the print head 6 is likewise necessary.

The print heads may be countersunk into the print bar. However, the print heads may also protrude from the print bar. The fold formation or undulation 14 in the recording medium thereby makes contact with at most one respective present print head protector. Although the print heads are in most instances protected by this protective measure, the recording medium is destroyed by the fold formation. Print image disturbances likewise occur, such that the print image must be generated again. Furthermore, the printing process is interrupted.

Until now, there has existed no solution to this problem of fold formation in a recording medium 5. Instead of this, for example in the event of different papers as recording media 5, these sporadically contact the print bar 2 and the nozzle plate of the print head 6, or if present, a print head protector of the print bar 2, for example depending on parameters such as the paper moisture and the print image and the print utilization that are connected therewith.

Shown in FIG. 3 is a side view of a printer 2 which has a print group 3 having multiple printing suction systems 10 according to an exemplary embodiment of the disclosure, as well as a transport device 4. However, the disclosure is not limited to the schematically shown transport device. Any form of the transport device which is suitable for the printer may be provided, depending on function and intended use.

Given the printing suction system 10 according to an exemplary embodiment of the disclosure, the respective print bar 2 of the print group 3 is coupled or combined with a suction device 11 in order to counteract a fold formation and smooth an undulation of the recording medium 5 having one or more ripples 14. In an exemplary embodiment, the suction device 11 includes processor circuitry that is configured to generate a suction pressure (e.g. negative pressure). In an aspect, the suction device 11 is additionally or alternatively configured to generate a blowing force (e.g. positive pressure). The suction device 11 can be, for example, a pump (e.g. pneumatic pump), vacuum, blower, fan, or other device configured to move air or other gases.

In an exemplary embodiment, the suction device 11 is arranged opposite the print bar 2, and in particular, opposite the underside of the print bar 2, and with this forms a gap 15 (as shown in FIG. 5) through which a recording medium 5 to be printed to is directed. In this instance, the recording medium 5 is smoothed and simultaneously printed to.

However, in an exemplary embodiment, the suction device 11 is alternative (or additionally) arranged just before the print bar 5, as considered in the transport direction of the recording medium 5. In comparison to the depicted exemplary embodiments in FIGS. 1 through 4, the suction device 11 would then be arranged somewhat to the right of the respective print bar 2, since in FIGS. 1 through 4 the transport direction travels from right to left. In this instance, the recording medium 5 is smoothed in advance and then printed to.

The actual printing gap 12 is formed between the top side of the recording medium 5 and the opposite underside of the print bar 2. In FIG. 5, a maximum allowable printing gap 12 is thereby designated with Dmax, and a minimum allowable printing gap 12 is additionally designated with Dmin.

In an exemplary embodiment, the recording medium 5 to be printed to is provided so that it can be directed through the formed printing gap 12, between the print bar 2 and the suction device 11. In an exemplary embodiment, the print bar 2, with its associated suction device 11, forms the printing suction system 10 according to the disclosure. FIG. 4 hereby depicts a plan view of a detail of the printer 1 according to FIG. 3. In FIG. 4, one of the print bars 2 is hereby shown, wherein the print bar 2 thereby has multiple print heads 6, for example. The suction devices 11 of the print bars 2 below the recording medium 5 are indicated with a dashed line in FIG. 4. In principle, in addition to having multiple print heads 6, depending on function and intended use a print bar 2 may also have only one print head. Furthermore, depending on function and intended uses the respective print bar 2 may have an additional print head protector.

FIG. 5 shows a section A-A through one of the printing suction systems 10 according to FIG. 3.

In the printer 1 shown in FIGS. 3, 4, and 5, the recording medium 5 that is to be printed to is transported along the print group 3 and its print bars 2 by the transport device 4 and its transport rollers 9. More precisely, the recording medium 5 to be printed to is directed through the gap 15, between the underside of the respective print bar 2 and the opposite top side of the suction device 11, and with the print bars 2 hereby forming the printing gap 12.

In an exemplary embodiment, in FIGS. 3, 4, and 5, a recording medium in the form of a web—for example a paper roll—is used, for example. Instead of a recording medium 5 in the form of a web, a recording medium in the form of a page or sheet may likewise be used.

In an exemplary embodiment, the recording medium 5 is, for example, comprised of or has paper, paper towel or tissue paper, fabric, cardboard, paperboard, plastic film, and/or metal foil. However, the disclosure is not limited to the cited examples for a recording medium 5. Any material, or any material combination, may be used as a recording medium 5 that is suitable to be printed to by the respective printing suction system 10 and to be suctioned by the suction device 11 of the respective printing suction system 10 in order to counteract a fold formation, or to smooth a possibly present undulation.

As was previously described with regard to FIGS. 1 and 2, a fold formation—and therefore an undulation—of the recording medium 5 may occur if the recording medium 5 experiences tensile forces of different magnitude in the transport direction due to the transport rollers 9 of the transport device 4, or—for example—has regions that are printed to with different strengths and therefore are of different dampness, to cite just a few reasons for the occurrence of a fold formation. In the following, still further causes for a fold formation of the recording medium 5, and an undulation of the recording medium 5 with one or more ripples 14 that is connected therewith, are additionally explained.

Such an undulation of the recording medium 5 due to fold formation is indicated in the view in FIGS. 4 and 5.

As is shown in FIGS. 3 and 5, the printing gap 12 is formed between the underside of the respective print bar 2 and the opposite side or top side of the recording medium 5. Due to an unwanted undulation of the recording medium 5, the printing gap 12 may be smaller than the minimum that is allowed, such that print image disturbances or an interruption of the printing process may occur, for example.

In an exemplary embodiment, in operation, the recording medium 5 is directed through the gap 15 between the underside of the print bar 2 and the top side of the associated suction device 11 of the respective printing suction system 10, and may hereby be printed to on its top side by the print bar 2 and its at least one print head 6, depending on a desired print image.

In FIG. 5, the recording medium 5' is smoothed with a dashed line and shown in a position in which the printing gap 12 is within a permissible tolerance range. The recording medium 5' is thereby smooth or flat and travels parallel to the underside of the print bar 2, in the Y-direction or width direction of the print bar 2.

In an exemplary embodiment, in addition to tensile forces of different magnitudes on the recording medium 5 in the transport direction T, due to the transport device 4 and its transport rollers 9, fold formation factors also influence a fold formation (and therefore undulation) in the recording medium 5, for example, the moisture of the recording medium 2, the ambient humidity, the external or ambient pressure, the density of the recording medium 2, the thickness of the recording medium 2, the width of the recording medium 5, the material or the material combination of the recording medium 2 (for example a wood fraction of the recording medium), the print image, etc.

Shown in FIG. 5, is a recording medium 5 which has a fold formation and therefore is wavy in the width or Y-direction. As was previously described with regard to FIGS. 1 and 2, such a fold formation in the recording medium 5 may lead to problems, for example a print image disturbance, an interruption of the printing process, damage to the print group, etc.

In an exemplary embodiment, in order to smooth the undulation produced by the fold formation in the width or Y-direction of the recording medium 5, the respective printing suction system 10 includes a suction device 11. In an exemplary embodiment, the suction device 11 is configured to apply a suction pressure profile in the width or Y-direction to a recording medium 5 directed through between the print bar 2 and the suction device 11 to smooth the undulation.

In an exemplary embodiment, as is shown in FIG. 5, the suction device 11 extends along the width of the print bar 2 and is thereby configured such that the curve of the height of its suction pressure is variable in the width or Y-direction, such that the suction pressure may vary along the width of the print bar 2. In principle, it is also possible to hold the suction pressure at a constant value across the width of the print bar 2, depending on function and intended use.

In this way, the curve of the suction pressure level, and therefore the shape of the suction pressure profile, may be adapted as needed along the width of the print bar 2 to an established undulation of a recording medium 5 in order to smooth its undulation if, in operation of the printer 1, the recording medium 5 is transported through the gap 15 between the print bar 2 and the suction device 11.

According to embodiments of the disclosure, the wavy (non-smooth) recording medium 5, depicted schematically in FIG. 5, may advantageously be suitably suctioned by the suction device 11 such that it is smoothed and lies within the permissible tolerance range for the printing gap 12, as is indicated in FIG. 5 by the dashed line for the smoothed recording medium 5'.

In an exemplary embodiment, the suction pressure profile of the suction device 11 is configured, as is indicated with arrows P1, P2, and P3 in FIG. 5, such that the outer edges of the recording medium 5 that are most strongly curved or curled toward the underside of the print bar 2 are suctioned with a greater suction pressure P1 and P3, whereas a middle segment of the recording medium 5 that is comparatively only slightly curved is simultaneously suctioned with a lesser suction pressure P2. In this way, the recording medium 5 may be advantageously smoothed so that it lies within the permissible range for the printing gap 12, as is indicated with the dashed line for the smoothed recording medium 5'. Ripples 14, in particular large ripples 14, of the recording medium 5 in the printing gap 12 are thus drawn downward or in the direction of the suction device 11 and thereby reduced in size. In an accelerated test, a reduction or smoothing of the ripple formation of the recording medium 5 could be reproduced.

In an exemplary embodiment, to determine a fold formation (and an undulation connected therewith) of a recording medium 5 in the width or Y-direction, the printing suction system 10 includes at least one fold formation determination device 13, as is indicated with a dashed line in FIG. 3, and/or be coupled with at least one external fold formation determination device 13 as is indicated with a dotted line in FIG. 3, for determination of an undulation of the recording medium 5 directed through the printing suction system 10, or of an undulation profile in the width or Y-direction.

In an exemplary embodiment, as shown in FIG. 3, a fold formation determination device 13—for example, an infrared measurement device—is provided before and/or after the printing suction system 10 in the transport direction of the recording medium 5, for example at its print bar 2 or suction device 11, to determine the surface contour or the surface profile of the recording medium 5, in particular, in the width direction, and therefore to determine a possibly present undulation of the recording medium 5. In an exemplary embodiment, the fold formation determination device 13 is a camera, sensor, or other device configured to measure or otherwise detect/determine a smoothness (e.g. degree of undulation) of the recording medium and/or the surface contour or the surface profile of the recording medium 5. In an exemplary embodiment, the fold formation determination device 13 includes processor circuitry that is configured to measure or otherwise detect/determine a smoothness (e.g. degree of undulation) of the recording medium and/or determine the surface contour or the surface profile of the recording medium 5. The fold formation determination device 13 can be referred to as the fold formation determiner or fold formation determination circuit.

However, according to the disclosure, the fold formation determination device 13 is not limited to this arrangement indicated in FIG. 3. In an exemplary embodiment, the fold formation determination device 13 may be arranged at any other position inside and/or outside of the print group 3 or the printing device 1, and may be part of the printing suction system 10 or be coupled with this as a separate fold formation determination device 13', as is indicated in FIG. 3, depending on the function and intended use and the manner of the fold formation determination device 13 or 13'.

In an exemplary embodiment, the fold formation determination device 13, 13' is configured to determine the undulation of the respective recording medium 5 (e.g. to measure at least one fold formation information, and/or to retrieve at least one fold formation information from a memory device (not shown), which fold formation information is stored in advance for the recording medium 5). The memory device may thereby be part of the fold formation determination device 13 or 13', or be a separate device/component and communicatively coupled with the fold formation determination device 13, 13'.

In an exemplary embodiment, based on the at least one item of fold formation information, the fold formation determination device 13 or 13' is configured to: determine an undulation or an undulation profile of the recording medium 5; retrieve an undulation or an undulation profile from the memory device, which undulation or an undulation profile of the recording medium 5 is to be expected for the at least one fold formation information; and/or interpolate an undulation or an undulation profile.

In an exemplary embodiment, on the basis of the determined undulation or an undulation profile of the recording medium 5, a suction pressure profile is subsequently determined for the suction device 11 of the printing suction system 10. In an exemplary embodiment, the suction pressure profile is configured such that it smooths the established undulation of the recording medium 5, at least smooths such that the recording medium 5 is within the tolerance range for the printing gap 12 of the printing suction system 10. In an exemplary embodiment, the suction device 11 is activated based on the suction pressure profile to smooth (e.g. sufficiently smooth) the recording medium 5.

In an exemplary embodiment, the suction pressure profile is, for example, calculated or stored in advance for an associated undulation or an undulation profile of the recording medium, so as to be retrievable, and may, if applicable, be interpolated.

In an exemplary embodiment, the fold formation information includes, for example, the degree of moisture of the recording medium 5, the degree of ambient humidity, the external or ambient pressure, the density of the recording medium, the thickness of the recording medium, the width of the recording medium 5, the ambient temperature, a material fraction (for example wood fraction) of the recording medium 5, a print image, the print utilization, and/or other characteristic and/or condition as would be understood by one of ordinary skill in the art. The disclosure is not limited to the aforementioned examples of a fold formation information. Any other information that is suitable to directly and/or indirectly determine or predict an undulation or an undulation profile of a recording medium 5 may be determined as fold formation information.

In an exemplary embodiment, the suction device 11 described with regard to FIG. 3 through 5, for example in the form of a suction bar, extends below the recording medium 5, for example between the transport rollers 9 of the transport direction, along the width of the print bar 2. The recording medium 5 may thereby be charged by the suction device 11 with a varying suction pressure level over its width, so that an established undulation of the recording medium 5 may be smoothed in a targeted manner and the adherence to a printing gap tolerance range may be ensured.

In an exemplary embodiment, as shown in FIG. 5, the suction device 11 includes one or multiple blower devices 16. In an exemplary embodiment with multiple blower devices 16, the blower devices 16 are arranged in, for example, at least one row along the width of the print bar 2. In an exemplary embodiment, the desired suction pressure profile that is suitable to smooth the recording medium is generated as needed by the blower devices 16 and be applied to a wavy recording medium 5. In an exemplary embodiment, a plate 17 with a common opening or nozzle, or at least one opening or nozzle, that is associated with the respective blower device 16, is provided above the blower devices 16 to generate a suction pressure on the oppositely situated recording medium 5 to suction the recording medium 5 with a predetermined suction pressure. The disclosure is not limited to this example of a suction device 11. Any form of suction device 11 may be provided that is suitable to generate a suction pressure profile along the width of the print bar 2 given which the suction pressure level is in particular varied or variable in order to smooth a recording medium directed through the gap 15. In an exemplary embodiment, the blower devices 16 includes processor circuitry that is configured to generate a blowing force (e.g. positive pressure). In an aspect, the blower devices 16 is additionally or alternatively configured to generate a suction pressure (e.g. negative pressure). The blower devices 16 can be, for example, a pump (e.g. pneumatic pump), blower, fan, or other device configured to move air or other gases.

In this way, the undulation formation of the recording medium 5 may be minimized in printing operation. This advantageously reduces the recording medium contact and print image disturbances connected therewith, as well as the occurrence of recording medium dust at this location. Furthermore, print head damage may be avoided, and the print head lifespan and the print quality may thereby be increased, for example given ARA or post-stream processing.

An additional advantage is that recording medium contact at the underside of the print bar and the nozzle plate of the print heads is reduced. Furthermore, the print quality and/or the stability of the print quality of the printer in inkjet printers may be increased. Moreover, a cost reduction may be achieved by increasing the print head lifespan and due to smaller downtimes of the printer.

Although the present disclosure has been entirely described in the preceding using preferred exemplary embodiments, it is not limited to these, but rather can be modified in various ways. In particular, the embodiments described in the preceding can also be combined with one another, in particular individual features hereof.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, other structural electronic hardware, or a combination thereof. A processor includes a microprocessor, a digital signal processor (DSP), central processing unit (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 printer
2 print bar
3 print group
4 transport device
5, 5' recording medium
6 print head
8 roll (take-off)
7 roll (take-up)
9 transport roller
10 printing suction system
11 suction device
12 printing gap
13, 13' fold formation determination device
14 ripple
15 gap
16 blower device
17 plate

The invention claimed is:

1. A printing suction system for a printer, comprising:
at least one print bar with at least one print head; and
at least one suction device arranged in proximity to an underside of the print bar thereby forming a gap through which a recording medium that can be printed to by the print bar can be directed,
wherein the suction device extends along a width of the print bar and is configured to generate a suction pressure based on a suction pressure profile along the width of the print bar to suction and smooth the recording medium, a curve of the suction pressure of the suction pressure profile being adapted along the width of the print bar based on an undulation of the recording medium.

2. The printing suction system according to claim 1, wherein the suction pressure profile of the suction device has a continuous, constant suction pressure along the width of the print bar.

3. The printing suction system according to claim 1, wherein the suction pressure of the suction pressure profile varies across the width of the print bar.

4. The printing suction system according to claim 1, further comprising: at least one fold formation determiner that is configured to:
determine the undulation of the recording medium directed through the gap, and
determine the suction pressure profile based on the determined undulation to smooth the undulation of the recording medium.

5. The printing suction system according to claim 4, wherein the at least one fold formation determiner is configured to detect at least one item of fold formation information, based on the undulation of the recording medium, wherein the at least one item of fold formation information is directly or indirectly determined.

6. The printing suction system according to claim 5, wherein the fold formation information is:
a degree of moisture of the recording medium;
a degree of ambient humidity;
an ambient pressure;
a density of the recording medium;
a thickness of the recording medium;

a width of the recording medium;

an ambient temperature;

a material fraction of the recording medium;

a height deviation from an ideal line of the recording medium;

a print image that is to be applied onto the recording medium; and/or a printing ink distribution on the recording medium.

7. The printing suction system according to claim 4, wherein the at least one fold formation determiner is configured to retrieve at least one item of fold formation information from a memory, the fold formation information having been stored in advance for the recording medium, wherein the undulation of the recording medium is directly or indirectly determined.

8. The printing suction system according to claim 1, wherein the printing suction system is coupled to at least one fold formation determiner that is configured to determine:

the undulation of the recording medium directed through the gap, and the suction pressure profile for smoothing the determined undulation.

9. The printing suction system according to claim 1, further comprising at least one fold formation determiner that is configured to measure a surface contour of the recording medium along the width of the print bar to determine the undulation of the recording medium.

10. The printing suction system according to claim 9, wherein the at least one fold formation determiner measures the surface contour using an infrared sensor, an ultrasound sensor, or a laser.

11. The printing suction system according to claim 1, wherein the suction pressure profile is calculated based on an established undulation of the recording medium determined by the printing suction system.

12. The printing suction system according to claim 1, wherein the suction pressure profile is predetermined and retrieved from a memory by the printing suction system.

13. A printer comprising at least one printing suction system according to claim 1.

14. The printer according to claim 13, wherein the printer is an inkjet printer.

15. A method to smooth a printable recording medium in a printer having a print bar and a suction device, the method comprising:

directing the recording medium through a gap formed between the print bar and the suction device;

suctioning, by the suction device, the recording medium to smooth an undulation of the recording medium, wherein the suction device extends along a width of the print bar and is configured to generate a suction pressure based on a suction pressure profile along the width of the print bar to suction and smooth the undulation of the recording medium recording medium; and adapting a curve of the suction pressure of the suction pressure profile along the width of the print bar based on the undulation of the recording medium.

16. A non-transitory computer-readable storage medium with an executable program stored thereon, wherein, when executed, the program instructs a processor to perform the method of claim 15.

17. A printing suction system for a printer, comprising:

at least one print bar with at least one print head; and at least one suction device arranged in proximity to an underside of the print bar thereby forming a gap through which a recording medium that can be printed to by the print bar can be directed, wherein the suction device extends along a width of the print bar and is configured to generate a suction pressure based on a suction pressure profile along the width of the print bar to suction and smooth the recording medium, the suction pressure profile being calculated based on an established undulation of the recording medium determined by the printing suction system.

18. A printer comprising at least one printing suction system according to claim 17.

19. The printer according to claim 18, wherein the printer is an inkjet printer.

* * * * *